US005393595A

United States Patent [19]

Rousset, deceased et al.

[11] Patent Number: 5,393,595

[45] Date of Patent: Feb. 28, 1995

[54] FIREBREAK FABRIC

[75] Inventors: Joseph Rousset, deceased, late of Paris; Félix G. Rousset, legal representative, Saint Paulien; Didier Royaerts, 09600 Regat, all of France

[73] Assignee: Didier Royaerts, Regat, France

[21] Appl. No.: 812,997

[22] Filed: Sep. 24, 1991

Related U.S. Application Data

[63] Continuation-in-part of Ser. No. 616,386, Nov. 21, 1990, abandoned.

[30] Foreign Application Priority Data

Nov. 22, 1989 [FR] France ..... 89 15327

[51] Int. Cl.[6] ..... D03D 3/00

[52] U.S. Cl. ..... 428/225; 66/202; 428/253; 428/902; 428/920

[58] Field of Search ..... 428/253, 902, 920, 225; 57/252; 66/202

[56] References Cited

U.S. PATENT DOCUMENTS 4,457,345 7/1984 Von Blücher et al. ..... 57/252
4,670,327 6/1987 Weber ..... 428/920
4,882,222 11/1989 Talley, Jr. et al. ..... 428/362

*Primary Examiner*—James J. Bell
*Attorney, Agent, or Firm*—Sandler, Greenblum & Bernstein

[57] ABSTRACT

A fabric suitable for use as a firebreak is knitted from a yarn formed from a first synthetic material having high mechanical strength and high reflectivity and a second non-flammable, thermally stabilized synthetic material having a high reflectivity. Preferably the first synthetic material is an aramide filament, and preferably the second synthetic material is a pre-oxidized filament. Preferably the fibers are cracked whereby they exhibit highly reflective surfaces especially useful in the reflection of heat produced by a fire.

24 Claims, 1 Drawing Sheet

FIREBREAK FABRIC

This application is a continuation-in-part of Ser. No. 07/616,386, filed Nov. 21, 1990, now abandoned, the disclosure of which is hereby incorporated in its entirety by reference thereto.

BACKGROUND OF THE INVENTION

1. Field of the Invention

The present invention concerns a new fabric for use as a firebreak. The invention is more particularly, but not exclusively, concerned with a fabric for use as a firebreak for forest fires.

2. Discussion of Background Material

It is known that forest fires are propagated mainly by radiation, the flame front temperature favoring the release of volatile substances contained in various tree species which are particularly flammable. The use of ceramic fiber-based fireproof fabrics as barriers to fight such fires has been considered. Devices of this kind have not yielded the desired results, and are additionally very costly, heavy and difficult to use. Finally, they merely constitute a simple mechanical screen. One object of the present invention is to provide a new lightweight fabric of reasonable cost which remedies the disadvantages of the known prior art technique.

SUMMARY OF THE INVENTION

The present invention pertains to a fabric suitable for use as a firebreak. The fabric is knitted from a yarn formed from a first synthetic material having high mechanical strength and high reflectivity, together with a second non-flammable, thermally stabilized synthetic material having a high reflectivity.

The first synthetic material is preferably a "KEVLAR" synthetic aramide filament. The second synthetic material is preferably a "SIGRAFIL 0" synthetic pre-oxidized filament. According to one feature of the invention, the first and second materials are cracked to provide fibers approximately 60 to 200 millimeters long, the resulting fibers being spun to produce a yarn which is then knitted to obtain the fabric.

The cracked fibers of the first and second synthetic materials, after cracking, have barbs or hairs forming a down on the surface of the yarn obtained after spinning. The distance between the barbs or hairs on the surface of a single filament is between one and a few tens of microns (e.g. 50 microns). The resulting structure forms an optical filter with cut-off wavelengths matching those of the emission spectrum of thermal radiation from a flame.

The yarn fibers of the first material, after cracking, spinning, and knitting, preferably form about 30% of the resulting fabric of the present invention. The yarn fibers of the second material, after cracking, spinning, and knitting, preferably form about 70% of the resulting fabric of the present invention. The result is a lightweight fabric that is easy to use and which once stretched and installed constitutes a firebreak barrier minimizing the radiation from a flame front.

The present invention also pertains to a method for protecting an object which can be damaged by exposure to a fire. The method comprises shielding the object with a firebreak, wherein the firebreak is a knitted fabric which comprises a yarn formed from a first synthetic material having high mechanical strength and high reflectivity and a second, non-flammable, thermally stabilized synthetic material having high reflectivity.

The present invention also pertains to a method for controlling the spreading of a fire. The method comprises placing a firebreak around at least a portion of the fire. The firebreak is a knitted fabric while comprises a yarn formed from a first synthetic material having high mechanical strength and high reflectivity and a second, non-flammable, thermally stabilized synthetic material having high reflectivity.

The present invention also pertains to a combination of an object to be preserved from damage from a fire in the proximity thereof, together with a firebreak, wherein the firebreak is a knitted fabric which comprises a yarn formed from a first .synthetic material having high mechanical strength and high reflectivity and a second, non-flammable, thermally stabilized synthetic material having high reflectivity.

The present invention also relates to a firebreak comprising a yarn formed from a first synthetic material having high mechanical strength and high reflectivity and a second, non-flammable, thermally stabilized synthetic material having high reflectivity.

DETAILED DESCRIPTION OF THE INVENTION

Figure 1:
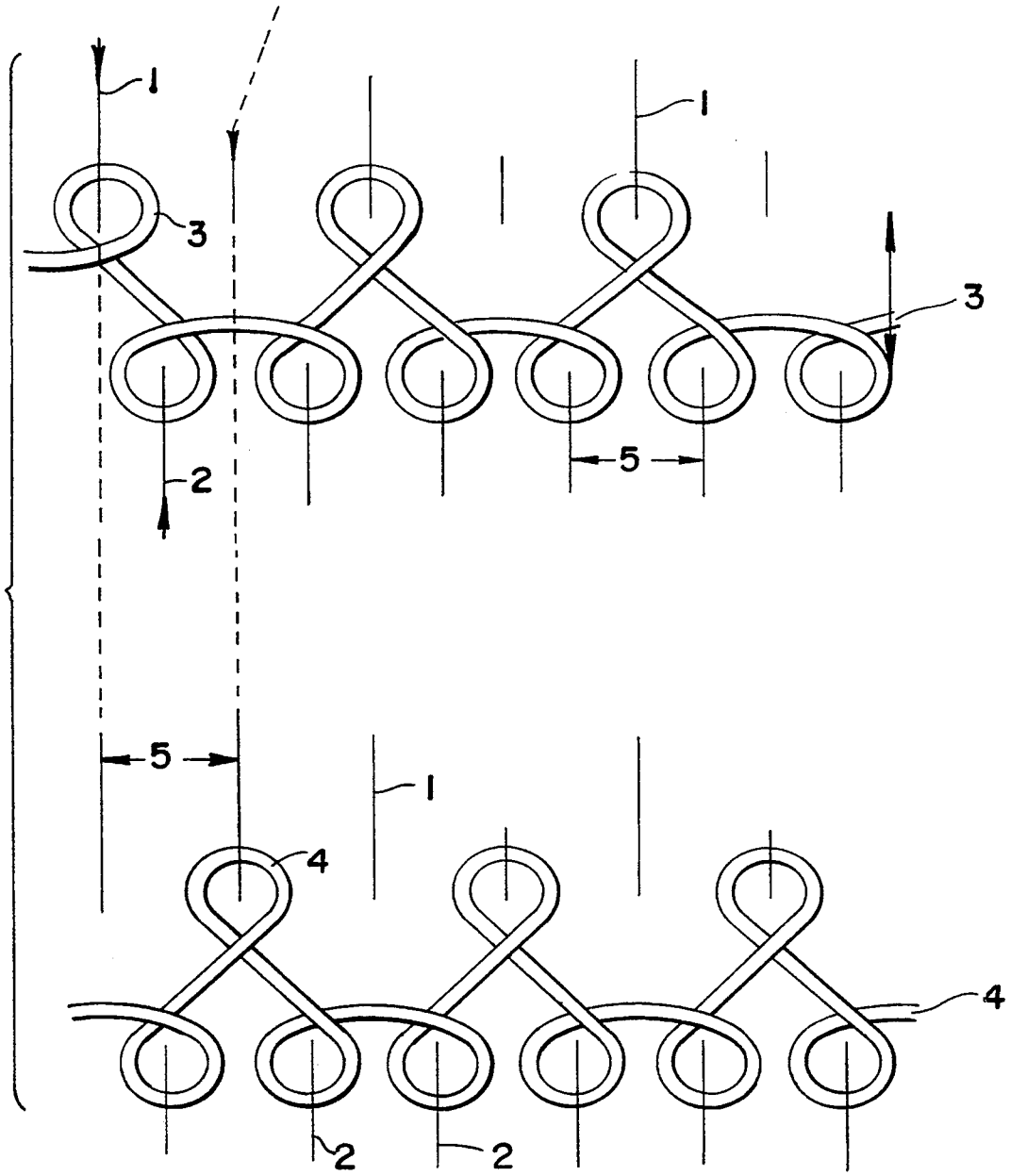
FIG. 1 illustrates an exploded, enlarged view of the fabric of the present invention.

The fabric of the present invention is formed from fibers made from an aramide synthetic filament commercially available under the trade name "KEVLAR" and a pre-oxidized synthetic filament commercially available under the trade name "SIGRAFIL 0". Kevlar synthetic aramide filament is known for its mechanical strength and light weight. The pre-oxidized synthetic filament has the advantage of being thermally stabilized and non-flammable and has a high melting point.

Each of these filaments is produced in the form of a continuous filament, via an extrusion process in which the fiber is formed by extruding the appropriate polymer through a die in order to form a continuous filament. The resulting continuous filaments are cracked by stretching them until they break. In general, the length of the fibers obtained after cracking may be from about 60 mm to about 200 mm. The fibers obtained after cracking are most preferably mixed in the proportion of about 70% pre-oxidized synthetic filament fibers together with about 30% aramide synthetic filament fibers.

Preferably the Kevlar synthetic aramide fiber is of approximately 1.7 dtex. The extruded Kevlar strand is subjected to cracking such that the continuous filament becomes discontinuous (i.e. is broken into relatively short lengths) upon stretching. Preferably the resulting cracked Kevlar filament exhibits a maximum length of about 140 mm and a minimum length of about 100 mm, with the cracked Kevlar filaments exhibiting an average length of about 120 mm.

Preferably the continuous preoxidized synthetic filament is of approximately 1.5 dtex. Upon cracking the continuous preoxidized filament, preferably the cracked preoxidized filament possesses an average length of about 150 mm, with a maximum length of about 180 mm, and a minimum length of about 120 mm.

Cracking is a very important step in the process of making the fabric of the present invention. Cracking is important because it enables the production of a "fluff" (i.e. "down") on the surface of the thread, thereby forming a network of reflector elements.

The cracked aramide filaments and cracked pre-oxidized filaments are mixed (preferably to a degree of substantial uniformity, and preferably in the proportions of 70 percent by weight preoxidized fiber, and 30 percent by weight aramide fiber) and thereafter spun to produce a yarn which is knitted to obtain the firebreak fabric of the present invention. Preferably the yarn which is spun from the mixture of filaments has a torque of 600 revolutions Z, and most preferably the yarn has a thickness of 20 tex (tex being equal to the weight in grams for a length of 10 meters). However, more generally the yarn thickness may vary from about 19.2 tex to about 20.8 tex.

In order to ensure that the knitted material provides great safety, each stitch of the fabric is formed of two threads. The knitted material, i.e. a jersey, is preferably manufactured on a circular knitting machine, and preferably the machine has thirty 18-gauge frame handles (i.e. 18 needles per frame). The circular knitting machine is preferably of the double bed type, i.e. the machine has needles on the cylinder as well as on the plate, so that the knitted material has rows of stitches on the front side thereof (i.e. by the cylinder needles) as well as on the reverse side (i.e. by the plate needles). Preferably the knitting machine has 24 drops thereon (i.e. 24 raised fiber suppliers), so that the machine forms 24 raised stitches per revolution. In each drop, each cylinder needle forms a stitch, whereas one of two plate needles forms a stitch (see FIG. 1).

FIG. 1 illustrates long cylindrical knitting needles (1) and short cylindrical knitting needles (2) which pass through loops of paired yarns (paired yarn 3 and paired yarn 4) undergoing knitting at respective positions drop no. 1 and drop no. 2. FIG. 1 illustrates the very substantial plate height preferred in the process of making the yarn utilized in the fabric of the present invention. A gap (5) between needles determines the distance between the stitches in the resulting fabric. The two threads shown at each needle drop position preferably have 50 filaments making up each thread.

It is important that the plate be at a very substantial height so that the stitch in-between is substantial. This enables a knitted material to be obtained with substantial breadthwise extension. Preferably the maximum height of the plate with respect to the cylinder is from about 2 millimeters to about 2.5 millimeters.

The tubular knitted material obtained on the circular frame preferably has a weight of about 200 grams per square meter. Furthermore, the knitted material tends to enlarge itself, given the stitch, and this tendency automatically brings about an opening of the stitch to create holes that imprison air. It is very important that each loop forming the stitch have a substantial dimension such that the knitted material obtained has a multiplicity of small holes therein. Thus the fabric of the invention not only has substantial breadthwise extension, furthermore the holes imprison some air that constitutes a natural thermal insulation. The holes are also necessary to slow the conduction of heat through the fabric.

The resulting fabric has some elasticity and the yarn obtained after cracking and spinning has the advantage of being both mechanically strong and heat resistant. The yarn has a downy surface.

The cracked synthetic fibers have an extremely shiny surface with a polished surface appearance such that the hairs and barbs which constitute the down on the surface of the yarn form an array of reflective elements spaced from each other by from about 0.1 micron to about 1 micron. The resulting structure forms an optical filter whose cut-off wavelengths match those of the emission spectrum of thermal radiation from a flame.

The fabric is stretched in front of a surface to be protected and thereby constitutes a dispersion, diffusion or diffraction filter whose reflection factor is very high for the wavelength concerned. Experiments have shown that for radiation temperatures between 30° and 950° C. it is possible to arrest approximately 90% of the heat flow.

The fabric may be used in the form of strips sewn together to constitute long lengths, the width of the strips being as much as six meters. The weight of a strip one hundred meters long by six meters high is approximately 60 kg. If the fabric is manufactured on a circular frame, it may be used in sock form with internally housed tensioning members.

The fabric in accordance with the invention has the advantage that it is not totally opaque, with the result that it enables visual verification of the action of fire-fighting equipment and allows hazards such as falling trees to be seen therethrough. The fabric can also be used to protect buildings.

In the very large number of trials that have been carried out, the best results were obtained with the new fabric as described and defined above. If the fabric of the present invention is used for applications in which the radiation temperatures are lower, the pre-oxidized synthetic filament might be replaced with polyamide fibers, polyester fibers, and/or acrylic fibers, each of which would be treated in the same way as the pre-oxidized synthetic filament.

Finally, although the invention has been described with reference of particular means, materials and embodiments, it is to be understood that the invention is not limited to the particulars disclosed and extends to all equivalents within the scope of the claims.

What is claimed is:

1. A fabric for use as a firebreak, comprising:

a knitted fabric formed by knitting a spun yarn made of first and second synthetic materials;

said first synthetic material comprising aramide fibers formed by cracking an aramide filament to provide said aramide fibers having lengths of from about 60 millimeters to about 200 millimeters in length;

said second synthetic material comprising thermally stabilized synthetic fibers having high reflectivity, said thermally stabilized synthetic fibers being formed by cracking a thermally stabilized synthetic filament to provide said thermally stabilized synthetic fibers having lengths of from about 60 millimeters to about 200 millimeters in length;

said spun yarn formed by mixing a majority of said second synthetic material with a minority of said first synthetic material and spinning the mixture to form said spun yarn.

2. The fabric according to claim 1, wherein said first and second synthetic materials each comprise barbs or hairs extending from said fibers at an angle to a longitudinal axis of the respective fiber.

3. The fabric according to claim 2, wherein said barbs are distributed on said fibers at a distance of between about one and about 50 microns.

4. The fabric according to claim 1, wherein said spun yarn comprises about 70% by weight of said second synthetic material and about 30% by weight of said first synthetic material.

5. The fabric according to claim 1, wherein said spun yarn comprises a thickness of from about 19.2 tex to about 20.8 tex.

6. The fabric according to claim 1, wherein said knitted fabric comprises stitches, said stitches each comprising two threads of said spun yarn.

7. The fabric according to claim 1, wherein said knitted fabric comprises a weight of about 200 grams per square meter.

8. The fabric according to claim 1, wherein said aramide fibers have a thickness of about 1.7 dtex, and said thermally stabilized synthetic fibers have a thickness of about 1.5 dtex.

9. The fabric according to claim 2, wherein said barbs or hairs form a down-like surface on said spun yarn, wherein a distance between each of said barbs or hairs ranges from about 0.1 micron to about 1.0 micron.

10. The fabric according to claim 1, wherein said knitted fabric comprises stitches, said stitches each comprising two threads of said spun yarn, said stitches forming holes which imprison air to provide thermal insulation and prevent said fabric from being completely opaque.

11. The fabric according to claim 1, wherein said aramide fibers have lengths of from about 100 millimeters to about 140 millimeters in length.

12. The fabric according to claim 1, wherein said thermally stabilized synthetic fibers have lengths of from about 100 millimeters to about 140 millimeters in length.

13. A fire-protected object, comprising:

an object which is vulnerable to fire; and a knitted fabric firebreak material provided on at least a portion of a surface of said object;

wherein said knitted fabric firebreak material is formed by knitting a spun yarn made of first and second synthetic materials;

said first synthetic material comprising aramide fibers formed by cracking an aramide filament to provide said aramide fibers having lengths of from about 60 millimeters to about 200 millimeters in length;

said second synthetic material comprising thermally stabilized synthetic fibers having high reflectivity, said thermally stabilized synthetic fibers being formed by cracking a thermally stabilized synthetic filament to provide said thermally stabilized synthetic fibers having lengths of from about 60 millimeters to about 200 millimeters in length;

said spun yarn formed by mixing a majority of said second synthetic material with a minority of said first synthetic material and spinning the mixture to form said spun yarn.

14. A method of making a firebreak material comprising:

cracking an aramide filament by stretching the filament until breaking to form aramide fibers having barbs or hairs extending therefrom;

cracking a thermally stabilized synthetic filament by stretching the thermally stabilized synthetic filament until breaking to form thermally stabilized synthetic fibers having barbs or hairs extending therefrom;

mixing the aramide fibers and stabilized synthetic fibers;

spinning the fiber mixture to produce a composite yarn; and knitting the spun yarn to produce a firebreak fabric.

15. The method of claim 14, wherein the aramide filament cracking is performed to produce aramide fibers of from about 100 mm to about 140 mm in length.

16. The method of claim 14, wherein the thermally stabilized synthetic filament cracking is performed to produce thermally stabilized synthetic fibers of from about 120 mm to about 180 mm.

17. The method of claim 14, wherein the mixing is performed at a ratio of about 70% by weight of the thermally stabilized synthetic fibers to about 30% by weight of the aramide fibers.

18. The method of claim 14, wherein the yarn is spun to have a thickness of from about 19.2 tex to about 20.8 tex.

19. The method of claim 14, wherein the fabric is knitted to comprise a weight of about 200 grams per square meter.

20. The method of claim 14, further comprising:

selecting an aramide filament of a thickness to form aramide fibers having a thickness of about 1.7 dtex after cracking.

21. The method of claim 14, further comprising:

selecting a thermally stabilized synthetic filament of a thickness to form thermally stabilized synthetic fibers having a thickness of about 1.5 dtex after cracking.

22. The method of claim 14, wherein the cracking, mixing and spinning steps form a yarn having a down-like surface formed by the barbs or hairs formed on the fibers, wherein a distance between each of the barbs or hairs ranges from about 0.1 micron to about 1.0 micron.

23. A method for protecting an object from exposure to fire, comprising:

placing a knitted fabric firebreak material between the object and the source of the fire, said knitted fabric being knitted from a yarn spun from a mixture of cracked first synthetic fibers having high mechanical strength and high reflectivity, and cracked, non-flammable, thermally stabilized second synthetic fibers having high reflectivity.

24. A method for controlling the spreading of a fire, comprising:

placing a knitted fabric firebreak material around at least a portion of the fire, said knitted fabric being knitted from a yarn spun from a mixture of cracked first synthetic fibers having high mechanical strength and high reflectivity, and cracked, non-flammable, thermally stabilized second synthetic fibers having high reflectivity.

* * * * *